US010029893B2

(12) United States Patent
Hancock

(10) Patent No.: US 10,029,893 B2
(45) Date of Patent: Jul. 24, 2018

(54) WINCH SYSTEM

(71) Applicant: George Hancock, Transfer, PA (US)

(72) Inventor: George Hancock, Transfer, PA (US)

( * ) Notice: Subject to any disclaimer, the term of this patent is extended or adjusted under 35 U.S.C. 154(b) by 67 days.

(21) Appl. No.: 15/210,329

(22) Filed: Jul. 14, 2016

(65) Prior Publication Data

US 2018/0016122 A1 Jan. 18, 2018

(51) Int. Cl.
*B66D 1/38* (2006.01)
*B66D 3/00* (2006.01)

(52) U.S. Cl.
CPC ..... *B66D 1/38* (2013.01); *B66D 3/006* (2013.01); *B66D 2700/0183* (2013.01)

(58) Field of Classification Search
CPC ... B66D 1/60; B66D 3/02; B66D 3/04; B66D 3/06; B66D 3/08
USPC ..... 254/323; 414/538, 543, 462, 541; 212/180
See application file for complete search history.

(56) References Cited

U.S. PATENT DOCUMENTS 4,239,440 A * 12/1980 James ..... B60P 1/4435 414/540
4,383,791 A * 5/1983 King ..... B60P 1/5428 414/542
4,700,851 A * 10/1987 Reeve ..... B66C 23/36 212/175
D304,672 S * 11/1989 Pearson ..... D8/331
5,028,198 A * 7/1991 Buhr ..... B60P 1/5442 212/180
5,511,929 A * 4/1996 Loftus ..... B60P 1/5423 212/180
5,720,400 A * 2/1998 Altizer, Sr. ..... B60P 1/5471 212/180
5,730,304 A * 3/1998 Duncan ..... B60P 1/5433 212/180
5,862,926 A * 1/1999 Johnson ..... B60P 1/5442 212/180
6,435,360 B1 * 8/2002 Buchmeier ..... B66C 1/10 212/180
6,505,764 B2 * 1/2003 Vining ..... B60R 9/00 224/403
7,070,059 B1 * 7/2006 Flowers ..... B60P 1/548 212/180
D532,577 S 11/2006 Elliott
7,392,975 B2 * 7/2008 Nespor ..... B60P 3/07 242/397
7,543,798 B2 6/2009 Cunningham
7,913,978 B1 3/2011 Trihey et al.
8,366,373 B2 * 2/2013 Wood ..... B60P 1/5471 212/175
8,534,980 B2 * 9/2013 Kuramoto ..... B60P 1/5409 212/180

(Continued)

FOREIGN PATENT DOCUMENTS

EP 0875483 5/1998

*Primary Examiner* — Emmanuel M Marcelo

(57) ABSTRACT

A winch system includes a truck that has a bed and the bed has a pair of spaced lateral walls. A winching unit is coupled to the truck. The winching unit includes a bar that has a telescopically adjustable length and the bar extends between the spaced lateral walls. The winching unit may be coupled to an object. Thus, the winching unit may urge the object into the bed thereby facilitating the truck to transport the object.

9 Claims, 5 Drawing Sheets

(56) References Cited

U.S. PATENT DOCUMENTS

| | | | | |
|---|---|---|---|---|
| 2007/0290181 | A1* | 12/2007 | Bell | B60P 1/548 254/323 |
| 2008/0164448 | A1* | 7/2008 | Duvall | B66D 3/006 254/323 |
| 2011/0123304 | A1* | 5/2011 | Thomas | B60P 3/122 414/538 |
| 2011/0204305 | A1* | 8/2011 | Ceccarelli | B60P 3/12 254/326 |
| 2015/0016931 | A1* | 1/2015 | Kuriakose | G05G 1/025 414/494 |

* cited by examiner

WINCH SYSTEM

BACKGROUND OF THE DISCLOSURE

Field of the Disclosure

The disclosure relates to winch devices and more particularly pertains to a new winch device for coupling a winch to trucks having a variety of widths.

SUMMARY OF THE DISCLOSURE

An embodiment of the disclosure meets the needs presented above by generally comprising a truck that has a bed and the bed has a pair of spaced lateral walls. A winching unit is coupled to the truck. The winching unit includes a bar that has a telescopically adjustable length and the bar extends between the spaced lateral walls. The winching unit may be coupled to an object. Thus, the winching unit may urge the object into the bed thereby facilitating the truck to transport the object.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
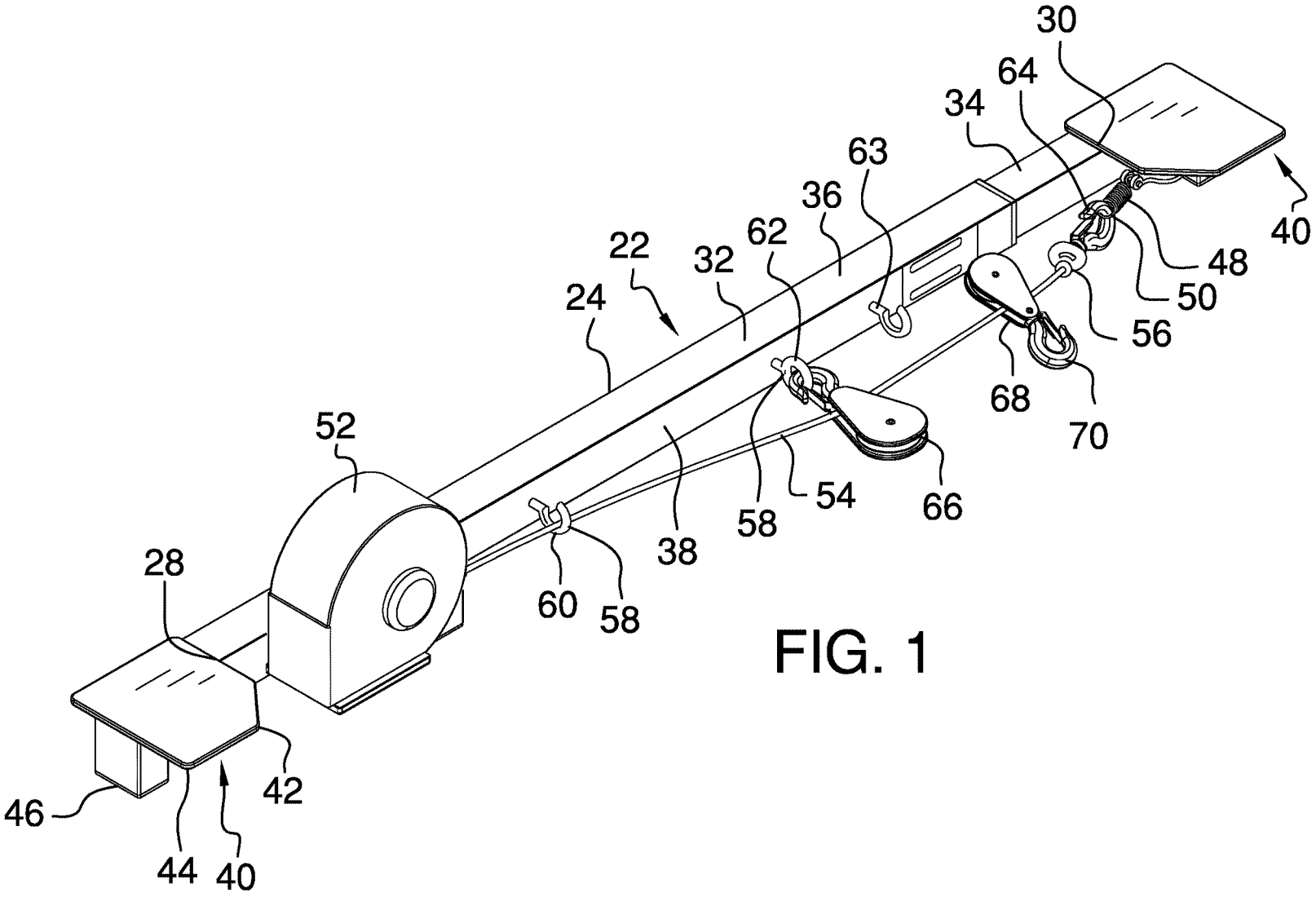
FIG. 1 is a top perspective view of a winch system according to an embodiment of the disclosure.
Figure 2:
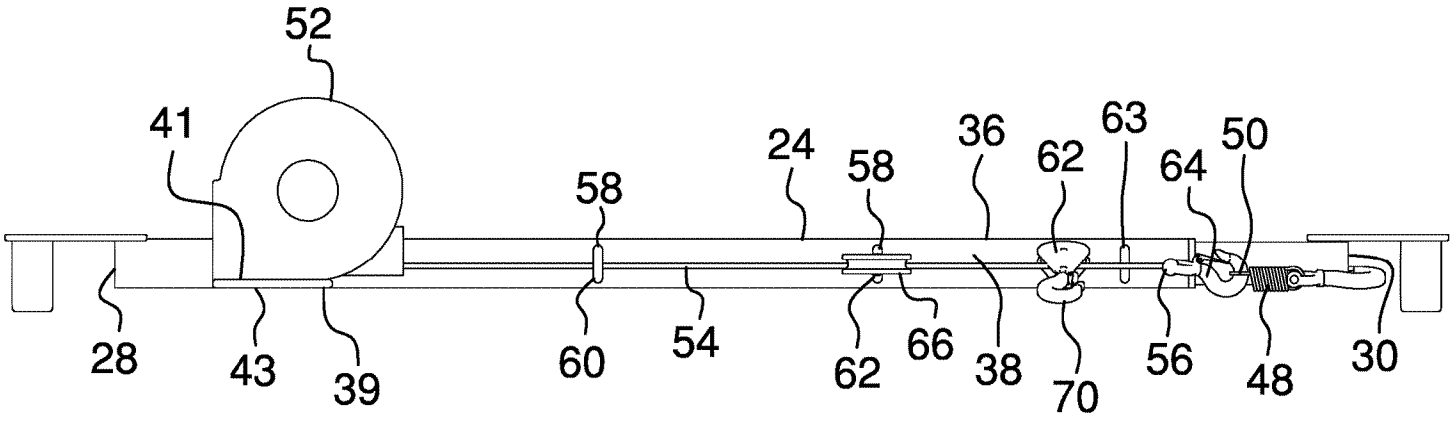
FIG. 2 is a front view of an embodiment of the disclosure.
Figure 3:
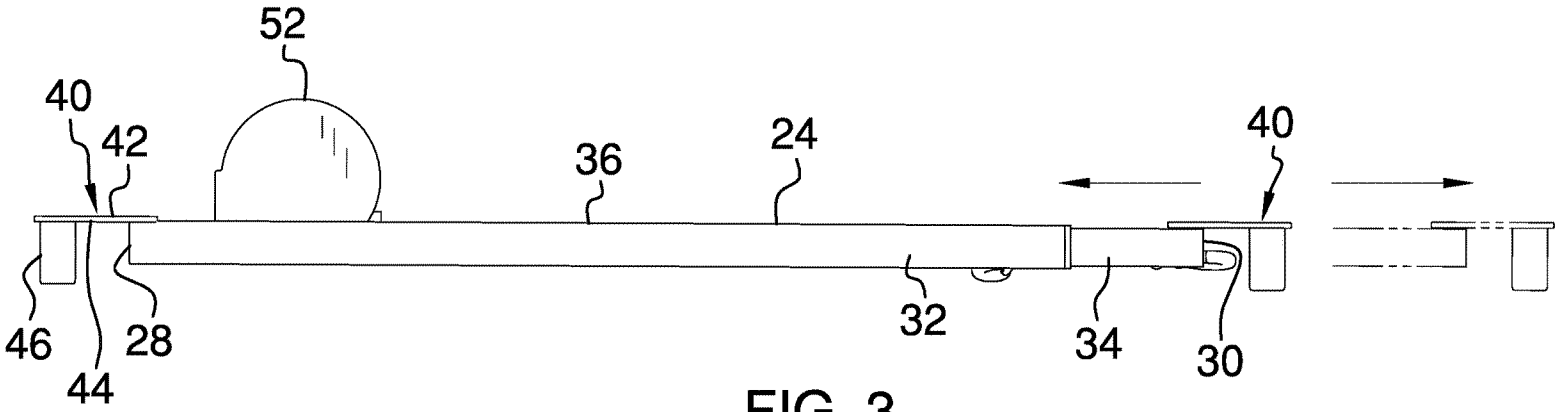
FIG. 3 is a back view of an embodiment of the disclosure.
Figure 4:
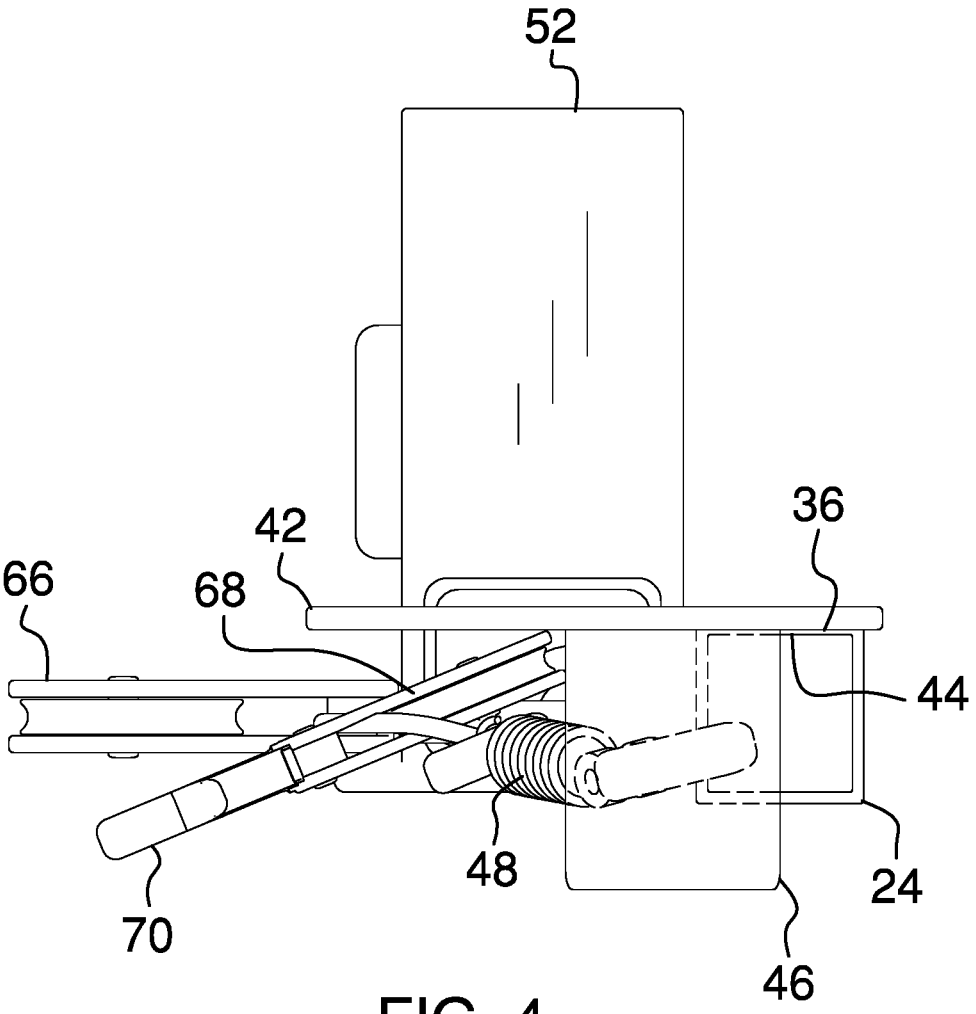
FIG. 4 is a left side view of an embodiment of the disclosure.
Figure 5:
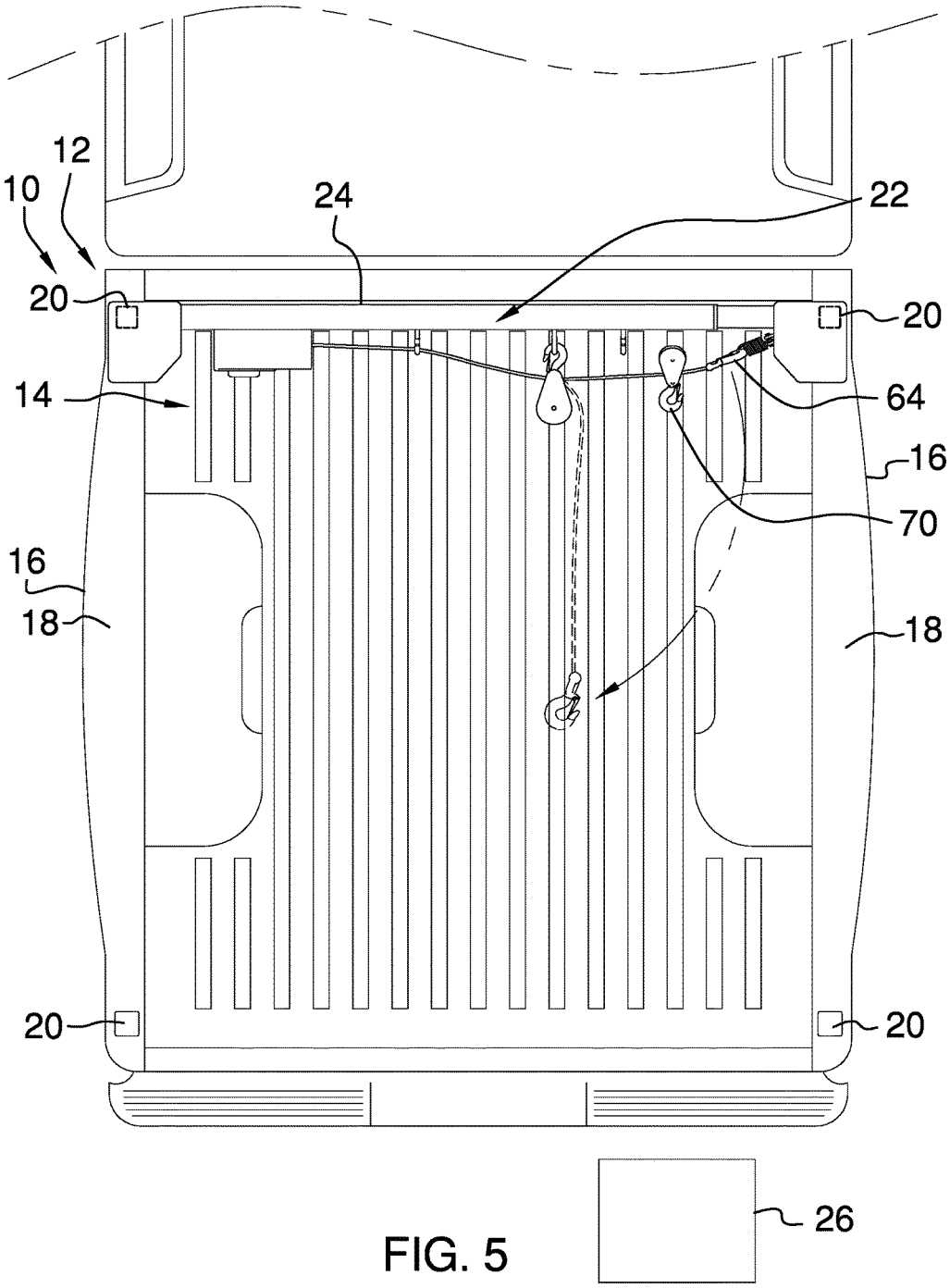
FIG. 5 is a perspective in-use view of an embodiment of the disclosure.
Figure 6:
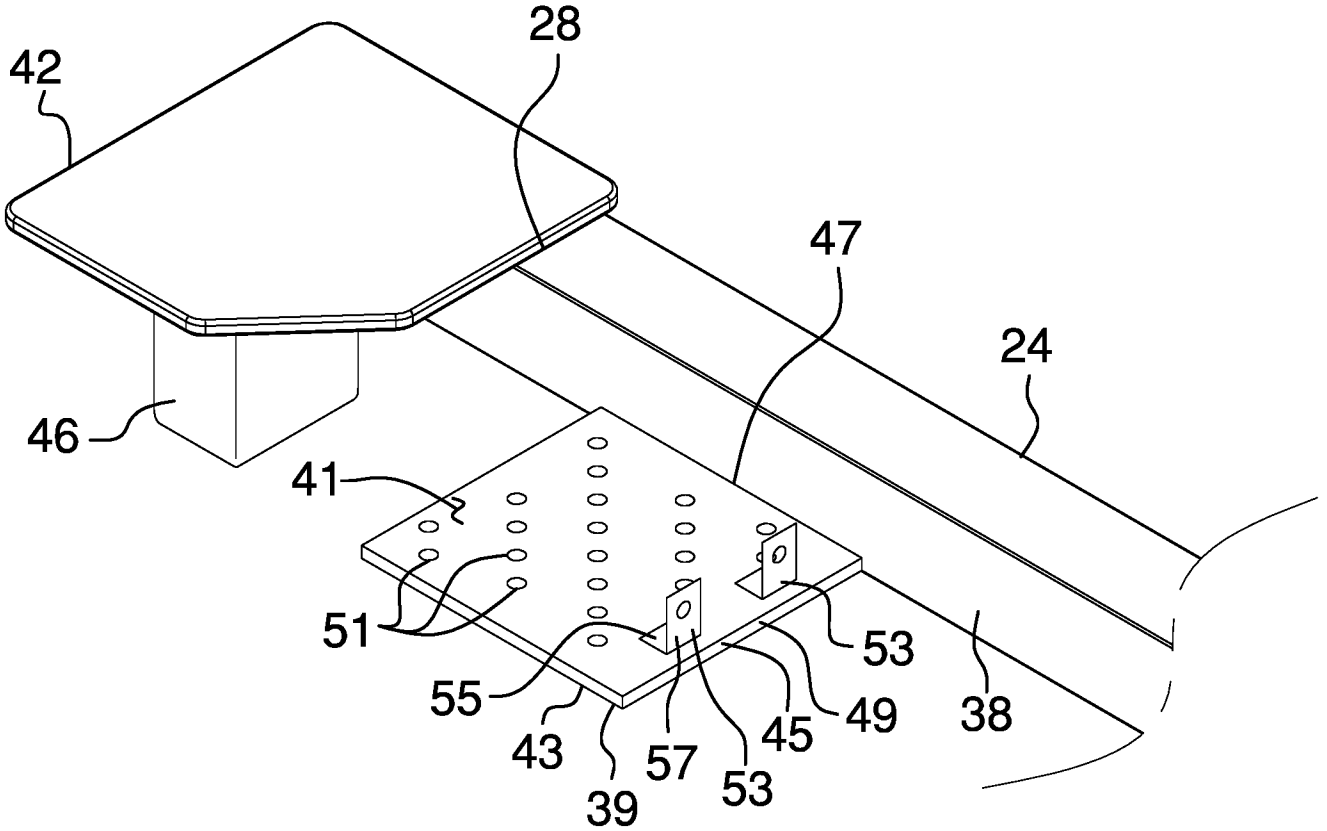
FIG. 6 is a right side perspective view of an embodiment of the disclosure.

With reference now to the drawings, and in particular to FIGS. 1 through 6 thereof, a new winch device embodying the principles and concepts of an embodiment of the disclosure and generally designated by the reference numeral 10 will be described.

As best illustrated in FIGS. 1 through 6, the winch system 10 generally comprises a truck 12 that has a bed 14. The bed 14 has a pair of spaced lateral walls 16 and each of the spaced lateral walls 16 has a top edge 18. The top edge 18 corresponding to each of the spaced lateral walls 16 has a plurality of wells 20 extending downwardly therein. The truck 12 may comprise a pickup or the like.

A winching unit 22 is provided and the winching unit 22 is removably coupled to the truck 12. The winching unit 22 includes a bar 24 that has a telescopically adjustable length. Thus, the winching unit 22 accommodates trucks with varying widths. The bar 24 extends between the spaced lateral walls 16. The winching unit 22 may be coupled to an object 26. Thus, the winching unit 22 may urge the object 26 into the bed 14 thereby facilitating the truck 12 to transport the object 26.

The bar 24 has a first end 28 and a second end 30. The bar 24 has a first section 32 that is slidably coupled to a second section 34. Thus, the bar 24 has the telescopically adjustable length. The bar 24 has a top side 36 and a front side 38.

A pair of mounts 40 is provided. Each of the mounts 40 is coupled to an associated one of the first end 28 and the second end 30 of the bar 24. Each of the mounts 40 engages an associated one of the spaced lateral walls 16. Thus, the bar 24 is removably coupled between the spaced lateral walls 16.

Each of the mounts 40 comprises a plate 42 that has a first surface 44 and the first surface 44 is coupled to the top side 36 of the bar 24. A tube 46 is coupled to and extends downwardly from the first surface 44. The tube 46 extends into a selected one of the wells 20 in the associated spaced lateral wall 16. The first surface 44 abuts the top edge 18 of the associated spaced lateral wall 16 such that the winching unit 22 is removably coupled to the bed.

A biasing member 48 is provided. The biasing member 48 is coupled to the mount 40 corresponding to the second end 30. The biasing member 48 has a distal end 50 with respect to the corresponding mount 40. The biasing member 48 may comprise a spring or the like.

A panel 39 is provided. The panel 39 has a top surface 41, a bottom surface 43 and a peripheral edge 45 extending therebetween. The peripheral edge 45 has a back side 47 and a first lateral side 49. The back side 47 is coupled to the front side 38 of the bar 24. The panel 39 is positioned closer to the first end 28 than the second end 30. The panel 39 has a plurality of apertures 51 extending through the top surface 43 and the bottom surface 45. The apertures 51 are spaced apart from each other and are distributed on the panel 39. The panel 39 may be spaced from the first end 28 of the bar 24 a distance ranging between seventeen cm and twenty two cm.

A winch 52 is provided and the winch 52 is coupled to the top surface 41 of the panel 39. The winch 52 includes a cable 54 that may selectively played outwardly from the winch 52. The cable 54 has a distal end 56 with respect to the winch 52 and the winch 52 is electrically coupled to the truck 12. The winch 52 may comprise an electric winch or the like.

A pair of bracket 53 is provided. Each of the brackets 53 includes a leg 55 and a foot 57. The leg 55 of each of the bracket 53 is coupled to the top surface 41 of the panel 39 having the brackets 53 being spaced apart from each other. Thus, the foot 57 extends upwardly from the panel 39. The foot 57 of each of the brackets 53 is substantially aligned with the first lateral side 49 of the panel 39. A roller unit for the winch 52 may be coupled to the foot 57 of each of the bracket 53.

The winch 52 may include a plurality of bolts. Each of the bolts is extended through selected ones of the apertures 51 in the panel 41. Thus, the winch 52 is secured to the panel 39. The plurality of apertures 51 facilitates varying designs of winches to be coupled to the panel 39.

A plurality of grips 58 is provided and each of the grips 58 is coupled to the front side 38 of the bar 24. The plurality of grips 58 includes a first grip 60, a second grip 62 and a third grip 63. The first grip 60 is positioned closer to the winch 52 than the second end 30 of the bar 24. The cable 54 extends through the first grip 60. Each of the grips 58 may comprise an eye hook or the like.

A first hook 64 is coupled to the distal end 56 of the cable 54. The first hook 64 may comprise a winch hook or the like. A first pulley 66 is removably coupled to the second grip 62. The cable 54 extends through the first pulley 66.

A second pulley 68 is movably positioned on the cable 54. The second pulley 68 is positioned between the first pulley 66 and the first hook 64. A second hook 70 is coupled to the second pulley 68. The second hook 70 may be selectively coupled to the object 26. The second hook 70 may comprise a winch hook or the like.

The first hook 64 is removably coupled to the biasing member 48 when the cable 54 is stored. The first hook 64 is selectively removed from the biasing member 48. Thus, the first hook 64 may be coupled to the object 26 thereby facilitating the winch 52 to urge the object 26 into the bed 14. The cable 54 travels along the first pulley 66 when the first hook 64 is coupled to the object 26. Thus, the first hook 64 and the first pulley 66 define a single block and tackle to multiply a load capacity of the winch 52.

In use, the mounting unit 22 is coupled between the spaced lateral walls 16 of the bed 14. The winch 52 is coupled to the panel 41. The cable 54 is extended through the first grip 60, the first pulley 66 and the second pulley 68. The first hook 64 is uncoupled from the biasing member 48 and the cable 54 is played outwardly from the winch 52. The first hook 64 is coupled to the object 26 and the winch 52 is turned on. Thus, the winch 52 urges the object 26 into the bed 14.

The first hook 64 remains coupled to the biasing member 48 and the second hook 70 is manipulated to play the cable 54 outwardly from the winch 52. The second hook 70 is coupled to the object 26 and the winch 52 is turned on. The second pulley 68 and the first pulley 66 form a double block and tackle when the second hook 70 is coupled to the object 26. Thus, the load capacity of the winch 22 is increased beyond the load capacity of the winch 22 corresponding to the single block and tackle.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A winch system comprising:

a truck having a bed, said bed having a pair of spaced lateral walls; and a mounting unit being coupled to said truck, said mounting unit including a bar having a telescopically adjustable length wherein said mounting unit is configured to accommodate varying widths of said bed, said bar extending between said spaced lateral walls, said bar has a first end and a second end, said bar having a first section being slidably coupled to a second section such that said bar has said telescopically adjustable length, said bar having a top side and a front side;

a winch being coupled to said mounting unit, said winch being configured to be coupled to an object wherein said winch is configured to urge the object into said bed thereby facilitating said truck to transport the object;

a cable being coupled to said winch, said cable being selectively extendable outwardly from said winch; and a panel having a top surface, a bottom surface and a peripheral edge extending therebetween, said peripheral edge having a back side, said back side being coupled to said front side of said bar, said panel being positioned closer to said first end than said second end, said panel having a plurality of apertures extending through said top surface and said bottom surface, said apertures being spaced apart from each other and distributed on said panel.

2. The system according to claim 1, further comprising a pair of mounts, each of said mounts being coupled to an associated one of said first end and said second end of said bar, each of said mounts engaging an associated one of said spaced lateral walls such that said bar is removably coupled between said spaced lateral walls.

3. The system according to claim 2, wherein:

each of said spaced lateral walls has a top edge, said top edge corresponding to each of said lateral walls having a plurality of wells extending downwardly therein; and each of said mounts comprises:

a plate having a first surface, said first surface being coupled to said top side of said bar, and a tube being coupled to and extending downwardly from said first surface, said tube extending into a selected one of said wells in said associated spaced lateral wall having said first surface abutting said top edge of said associated spaced lateral wall such that said winch is removably coupled to said bed.

4. The system according to claim 2, further comprising a biasing member being coupled to said mount corresponding to said second end, said biasing member having a distal end with respect to said mount.

5. The system according to claim 1, further comprising a plurality of grips, each of said grips being coupled to said front side of said bar, said plurality of grips being spaced apart from each other and being distributed along said bar, said plurality of grips including a first grip, a second grip and a third grip, said first grip being positioned closer to said plate than said second end of said bar, said cable extending through said first grip.

6. The system according to claim 5, further comprising a first pulley being removably coupled to said second grip, said cable extending through said first pulley.

7. The system according to claim 6, further comprising:

a first hook being coupled to a distal end of said cable relative to said winch; and a second pulley being movably positioned on said cable, said second pulley being positioned between said first pulley and said first hook, said second pulley having a second hook being coupled thereto wherein said second hook is configured to be selectively coupled to the object.

8. The system according to claim 6, further comprising a first hook being removably coupled to a biasing member such that said cable extends along said bar, said first hook being selectively removed from said biasing member wherein said first hook is configured to be coupled to the object thereby facilitating said winch to urge the object into said bed, said cable traveling along said first pulley when said first hook is coupled to the object such that said first hook and said first pulley define a block and tackle wherein said first hook and said first pulley are configured to multiply a load capacity of said winch.

9. A winch system comprising:

a truck having a bed, said bed having a pair of spaced lateral walls, each of said spaced lateral walls having a top edge, said top edge corresponding to each of said lateral walls having a plurality of wells extending downwardly therein; and a mounting unit being coupled to said truck, said mounting unit including a bar having a telescopically adjustable length wherein said mounting unit is configured to accommodate varying widths of said bed, said bar extending between said spaced lateral walls, said mounting unit comprising:

said bar having a first end and a second end, said bar having a first section being slidably coupled to a second section such that said bar has said telescopically adjustable length, said bar having a top side and a front side, a pair of mounts, each of said mounts being coupled to an associated one of said first end and said second end of said bar, each of said mounts engaging an associated one of said spaced lateral walls such that said bar is removably coupled between said spaced lateral walls, each of said mounts comprising:

a plate having a top surface, a bottom surface and a peripheral edge extending therebetween, said peripheral edge having a first side, said first side being coupled to said front side of said bar having said plate, said plate being positioned closer to said first end than said second end, said plate having a plurality of apertures extending through said top surface and said bottom surface, said apertures being spaced apart from each other and distributed on said plate, a tube being coupled to and extending downwardly from a first surface of said plate, said tube extending into a selected one of said wells in said associated spaced lateral wall having said first surface abutting said top edge of said associated spaced lateral wall such that said mount is removably coupled to said bed;

a biasing member being coupled to said mount corresponding to said second end, said biasing member having a distal end with respect to said mount, a panel having a top surface, a bottom surface and a peripheral edge extending therebetween, said peripheral edge having a back side, said back side being coupled to said front side of said bar, said panel being positioned closer to said first end than said second end, said panel having a plurality of apertures extending through said top surface and said bottom surface, said apertures being spaced apart from each other and distributed on said panel, a plurality of grips, each of said grips being coupled to said front side of said bar, said plurality of grips being spaced apart from each other and being distributed along said bar, said plurality of grips including a first grip, a second grip and a third grip, said first grip being positioned closer to said plate than said second end of said bar; and a winch being coupled to said panel, said winch including a cable being selectively played outwardly from said winch, said cable extending through said first grip, said cable having a distal end with respect to said winch, said winch being electrically coupled to said truck;

a first hook being coupled to said distal end of said cable, a first pulley being removably coupled to said second grip, said cable extending through said first pulley, a second pulley being movably positioned on said cable, said second pulley being positioned between said first pulley and said first hook, said second pulley having a second hook being coupled thereto wherein said second hook is configured to be selectively coupled to the object, said first hook being removably coupled to said biasing member such that said cable extends along said bar, and said first hook being selectively removed from said biasing member wherein said first hook is configured to be coupled to the object thereby facilitating said winch to urge the object into said bed, said cable traveling along said first pulley when said first hook is coupled to the object such that said first hook and said first pulley define a block and tackle wherein said first hook and said first pulley are configured to multiply a load capacity of said winch.

* * * * *